United States Patent [19]

Kaplan

[11] 4,403,426

[45] Sep. 13, 1983

[54] HEEL LIFT

[76] Inventor: S. Richard Kaplan, 5328 W. Grove St., Skokie, Ill. 60077

[21] Appl. No.: 287,306

[22] Filed: Jul. 27, 1981

[51] Int. Cl.[3] ..... A43B 21/36; A43B 21/39

[52] U.S. Cl. ..... 36/36 R; 36/36 C; 36/35 A

[58] Field of Search ..... 36/35 A, 35 B, 36 R, 36/36 C; 411/521

[56] References Cited

U.S. PATENT DOCUMENTS

| | | | |
|---|---|---|---|
| 1,947,840 | 2/1934 | Fitzsimmons | 36/36 |
| 2,321,157 | 6/1943 | Rees | 85/36 |
| 2,712,262 | 7/1955 | Knohl | 85/36 |
| 2,923,071 | 2/1960 | Whitted | 36/36 |
| 3,040,452 | 6/1962 | Whitted, Jr. | 36/34 |
| 3,041,744 | 7/1962 | Brauner | 36/34 |
| 3,055,125 | 9/1962 | Ronci | 36/34 |
| 3,134,180 | 5/1964 | Stone | 36/36 R |
| 3,141,248 | 7/1964 | Harris | 36/36 |
| 3,178,835 | 4/1965 | Burke et al. | 36/36 R |
| 3,320,846 | 5/1967 | Orain | 411/521 |

*Primary Examiner*—Werner H. Schroeder
*Assistant Examiner*—Steven N. Meyers
*Attorney, Agent, or Firm*—McDougall, Hersh & Scott

[57] ABSTRACT

A heel lift comprises an elongated body portion having a blunt or pointed upper end for insertion into a shoe heel, a lock washer or ring member with inwardly directed projections fitted and locked about the body portion and a head portion connected to the lower end of the body portion, the head portion having a slot and an annular undercut which cooperate to form passages within the head portion through which a molding material forming a wearing portion can flow when the lock washer and the head portion are coated with the molding material whereby the wearing portion is firmly bonded to the head portion.

15 Claims, 6 Drawing Figures

FIG. 1
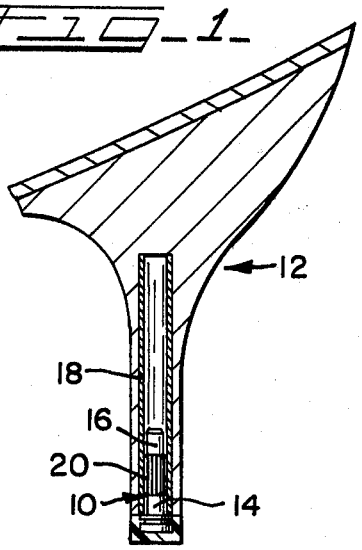
FIG. 2
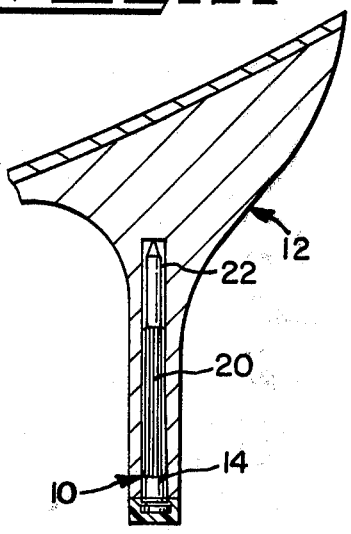
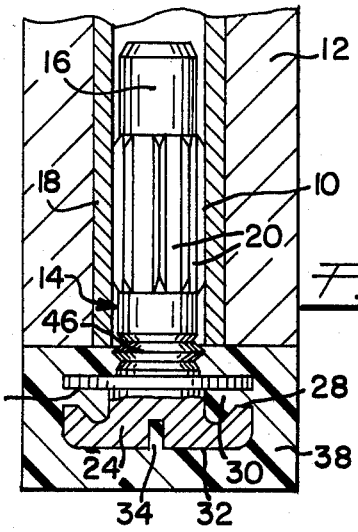
FIG. 3
FIG. 4
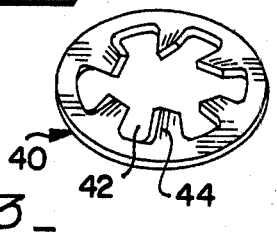
FIG. 5
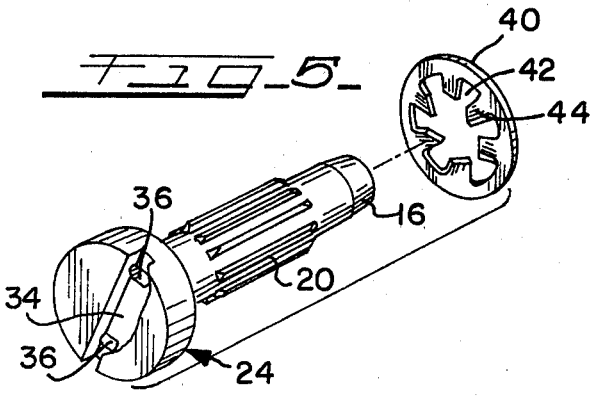
FIG. 6
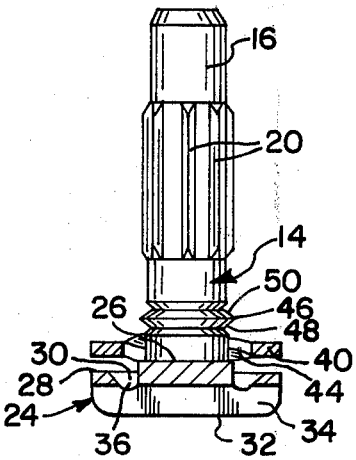

HEEL LIFT

BACKGROUND OF THE INVENTION

The present invention relates to replaceable heel lifts of the type primarily used in the construction of high heel shoes for women.

High heel shoes are often manufactured with extremely thin heel portions. As a result, the weight of the wearer is concentrated on an extremely small heel area. Because these heel portions can be subjected to a great deal of abuse, the tendency toward wearing of these heels relative to lower heels is substantially increased.

This greater wearing problem has resulted in the need for more frequent replacement of the lifts. Moreover, the small cross-sectional area of these thin heels makes the nailing of a leather lift to the heel impracticable. Over the years, improvements have been made in the synthetic materials used in the wearing portion of the lifts to provide a more durable heel that wears for a longer period; however, the method of manufacturing such heel lifts is complicated and expensive. In short, the extremely small size of the lifts has made it difficult to provide a durable construction and certain manufacturing methods have not permitted the use of the most durable material.

DESCRIPTION OF THE PRIOR ART

The following references constitute the most pertinent prior art of which applicant is aware.

U.S. Pat. No. 1,947,840 to Fitzsimmons shows a lift comprising a post formed by rolling a flat metal blank into a triangular conformation having offset lugs and a plate having downturned lugs which is secured about the post to engage a top lift or wearing portion.

U.S. Pat. No. 2,231,157 to Rees discloses a fastener device for preventing the axial displacement of a stud secured to a workpiece. A spring washer is provided with a plurality of axially driven resilient prongs which lock about the body portion of a shaft to prevent rotation of the shaft.

U.S. Pat. No. 2,712,262 to Knohl relates to a sheet metal retainer washer adapted to be telescopically associated with a peripheral surface of a post member and a counterbore of a hollow cylindrical member. The washer includes prongs for lockingly engaging the post member to center the post member with the counterbore.

U.S. Pat. No. 2,923,071 to Whitted describes a lift construction comprising a post portion with longitudinally extending fillets on the outer surface thereof for insertion into a bore in a heel. Secured to one end of the post is a lift or wearing portion.

U.S. Pat. No. 3,040,452 to Whitted, Jr. provides means for employing certain durable heel materials such as rubber. A heel lift construction is described which permits the molding of rubber and other materials to a specific pin construction whereby a longer wearing heel lift is provided. The pin construction is shaped like a nail so that the heel lift can be advantageously incorporated in the heel body.

U.S. Pat. No. 3,041,744 to Brauner shows a dowel for retaining lifts on the heel of a shoe. A nail having a small shoulder slightly larger than the shaft of the nail and an outwardly flared head is inserted and force fitted into an eyelet having a barrel-shaped body and plurality of claws. The claws engage the wearing portion of the lift to prevent separation of the wearing portion from the nail.

U.S. Pat. No. 3,055,125 to Ronci describes a reinforced plastic heel. A shank has a plastic cap forming a wearing portion molded to one end thereof and can be driven into the reinforced core of the heel. The shank also includes an enlarged head adjacent a flat annular central portion with radially extending arms that frictionally engage the surface of the shank; the plastic is molded about that assembly.

U.S. Pat. No. 3,141,248 to Harris relates to a heel lift having a pin shaped construction with a washer-like member around the body portion and adjacent to the head portion of the heel lift. A molding material can be formed about the head portion an the washer-like member to provide a durable, long-lasting heel.

Accordingly, the prior art contains several designs for heel lift constructions. However, heels are often made with a wearing portion comprising the molding material which has a diameter much less than that contemplated by the prior art. Consequently, the need for a firm bond between the wearing portion and the head portion of the lift has become even more important. The heel lift of the present invention is constructed to increase the bonding or adhesion between the wearing portion and the metal of the pin construction so that the need for frequent replacement of the lift is avoided.

SUMMARY OF THE INVENTION

The heel lift construction of the present invention comprises an elongated body portion having a blunt or pointed upper end whereby the heel lift can be inserted or nailed, respectively, into a shoe heel. A head portion having a slot across a first surface and an annular undercut through a second surface that is connected to the lower end of the body portion communicates with a lock washer or ring member having twisted projections adapted to be fitted and locked about the body portion adjacent the head portion. A wearing portion comprising a molding material is formed around the combination of the head portion and the lock washer. The slot and undercut of the head portion cooperate to form passages within the head portion through which the molding material can flow to securely attach the wearing portion to the lift. It has been found that the lock washer in combination with the slot and undercut of the head portion provide a highly efficient means for securing the molding material in the lift construction. Moreover, the assembly of the present heel lift is an extremely simple operation and, accordingly, manufacture of the heel lift construction is commercially practicable.

It is an object of this invention to provide a heel lift construction that is durable and can be efficiently used with shoes having extremely narrow heels.

It is an additional object of this invention to provide a heel lift construction that is simple to manufacture so that heel lifts can be produced economically.

These and other objects of this invention are further described hereinafter with reference to the following drawings.

BRIEF DESCRIPTION OF THE DRAWINGS

FIG. 1 is a sectional view of the heel lift of the present invention having a body portion with a blunt end for insertion into a metal sleeve contained within a heel;

FIG. 2 is a sectional view of the heel lift having a pointed body portion for insertion within a pre-drilled hole of a heel;

FIG. 3 is a detailed sectional view of the heel lift of FIG. 1;

FIG. 4 is a perspective view of a lock washer;

FIG. 5 is a perspective view of the lock washer engaging the body portion of the heel lift; and FIG. 6 is a sectional view to better illustrate the construction of the head portion of the heel lift.

DETAILED DESCRIPTION OF THE INVENTION

The accompanying drawings show the heel lift construction of the present invention which is generally indicated by the reference numeral 10. Two embodiments of that construction are illustrated in FIGS. 1 and 2 in combination with a shoe heel 12.

With specific reference to FIG. 1, a first embodiment of the heel lift construction 10 comprises an elongated body portion 14 having a blunt upper end 16 which facilitates insertion of the body portion 14 into a metal sleeve 18 contained within the shoe heel. Ridges 20 extend axially along the body portion 14 to provide an effective gripping interaction between the body portion and the metal sleeve 18 when the lift construction is inserted into a shoe heel.

Referring now to the alternative embodiment shown in FIG. 2, the heel lift 10 can include the elongated body portion 14 and a pointed upper end 22 which can be inserted directly into a pre-drilled hole in the shoe rather than into the metal sleeve 18 of FIG. 1. The pre-drilled hole can either extend partially into or totally through the shoe heel. In either case, the elongated body portion 14 should substantially fill the pre-drilled hole. The lifts of FIGS. 1 and 2 are similar, however, in that the ridges 20 extend axially along the body portion in both embodiments to establish a firm grip between the heel lift and the shoe heel.

FIG. 3 is an enlarged sectional view of the heel lift of FIG. 1, except, of course, for the difference in the shape of the upper end of the body portion 14. A head portion 24, which is shaped like a nail head, includes a shoulder 26 forming an upper surface 28 which is integrally connected to the lower end of the body portion 14. The upper surface 28 includes an annular undercut 30 that is concentric with the longitudinal axis of the body portion. The lower surface 32 of the head portion 24 has a slot 34 extending tranversely across that surface and into the head portion to overlap the annular undercut and to cooperate with the undercut whereby passages 36 are formed within the head portion. As can be better explained with reference to FIG. 6, a molding material can flow through the passages 36 to form a wearing portion 38 that is firmly bonded to the head portion.

A lock washer or ring member 40 shown in FIG. 4 is fitted around the body portion 14 and moved into a position adjacent the head portion 24 so that the lock washer is positioned and locked flush against the shoulder 26 of the head portion. It is desirable to use a lock washer 40 having an internal diameter slightly smaller than the outside diameter of the body portion 14. With this arrangement the lock washer 40 can be held in a fixed position relative to the body portion 14, and the molding operation to form the wearing portion 38 can be facilitated. If necessary, the wearing portion can then be trimmed in a machining operation to the desired diameter; the construction of the head portion and the lock washer prevent the wearing portion from spinning about the head portion during trimming. It will be noted that the locker washer may assume various internal designs to permit passage of molding material between the washer and the body portion; preferably, however, the lock washer has a circular internal diameter.

As described, a molding operation is performed to provide the wearing portion 38 of the heel lift. The molding may be carried out by conventional molding techniques such as injection molding, compression molding or casting; and various well-known molding materials including natural and synthetic rubbers and plastics can be used to form the wearing portion.

The construction of this invention provides for the securing of the wearing portion 38 to the head portion 24 so that the durability of the lift is enhanced substantially by the presence of the passages 36 and the lock washer 40. As best shown in FIGS. 4 and 5, the molding material extends into the undercut 30, the slot 34 and the passages 36 within the head portion 24. The molding material also extends into the spaces 42 defined between the lock washer 40 and the head portion. The gripping action of this configuration has been found to be highly effective.

The lock washer 40 can comprise a flat washer or ring member; however, certain preferred designs have been developed. In FIG. 4, the lock washer 40 includes fingers 44 which are bent or twisted to between 30° and 60° relative to the plane of the washer and extend inwardly to engage the body portion 14. Spaces 42 defined between the fingers increase the number of spaces through which the molding material will pass to improve the gripping action. The outer peripheral portion of the lock washer can have an outside diameter which is either less than, equal to, or greater than the diameter of the head portion 24. In preferred practice, however, the outside diameter of the lock washer is approximately equal to that of the head portion.

The preferred embodiment also includes fingers 44 that are twisted to a 45° angle relative to the plane of the lock washer. This enables the fingers 44 to engage the body portion 14 more firmly through what is referred to in the art as a "line bite" so that the lock washer 40 does not rotate about the body portion. As a result, there is less tendency for the wearing portion 38 to rotate about the head portion 24 as the heel wears down or when the wearing portion 38 is trimmed to the desired diameter in the manufacturing process.

Stop means may be formed in the body portion 14 which are adapted to hold the lock washer against the shoulder 26, or in spaced-apart relationship with respect to the head portion. These means may comprise one or more annular projections 46 extending outwardly from the body portion, or the body portion may be provided with a noncircular cross section for a short distance above the head portion 24. In addition, the annular projection 46 can include a lower sloped surface 48 and an upper sloped surface 50. During the molding operation, the material which forms the wearing portion 38 is pressfit against the upper sloped surface 50 so that the wearing portion adheres to the annular projection and cannot float or rotate about the head portion 24. Specifically, in the molding of the wearing portion 38, the body portion 14 is inserted through a bore in the mold so that the upper sloped surface 50 of the annular projection 46 contacts the mold. When the molding material is injected into the mold cavity, the material is formed about the circumference of the annular projection 46 on the upper sloped surface 50 to form the pressfit between the molding material and the heel lift. As previously described, the pressfit prevents the wearing portion from floating or rotating about the head portion 24.

It will be appreciated that the heel lift construction described can be manufactured in an extremely simple and economical fashion. Thus, the lock washer 40 used in the construction can be assembled with the body portion 24 with a minimum of effort, and there are no expensive or time consuming operations necessary for preparing the construction for the molding operation. The described construction is, therefore, extremely advantageous since expensive machining operations previously used for providing gripping surfaces in shoe lift constructions have been eliminated. Moreover, inexpensive materials conventionally used in the manufacture of shoe lifts can be employed in the construction of this invention. Therefore, metals such as steel can be used for the body and head portion and the lock washer, while various natural and synthetic rubbers and plastics are used for the wearing portion.

It will be understood that various changes and modifications can be made in the construction described without departing from the spirit of the invention, particularly as defined in the following claims.

What is claimed is:

1. A replaceable heel lift construction comprising:

(a) an elongated body portion having a plurality of ridges extending axially along the body portion;

(b) a head portion having an upper surface which includes a continuous annular undercut coaxial with the body portion, said upper surface being connected to the lower end of said body portion, and a lower surface including a slot extending radially therethrough across the head portion and in communication with said annular undercut to form at least one passage within said head portion;

(c) a ring member fitting around said body portion adjacent the upper surface of said head portion, said ring member comprising a continuous outer peripheral portion and having inwardly extending fingers engaging said body portion, the internal ends of said fingers defining a central opening in said ring member having a diameter slightly less than the outer diameter of said body portion whereby engagement of said fingers with said body portion serves to hold said ring member in place on said body portion in spaced apart relationship with respect to said head portion; and (d) a wearing portion formed of a molding material surrounding said head portion, said ring member and the spaces defined between said fingers and between said outer peripheral portion and said body portion, said molding material also extending between said head portion and said ring member and within the annular undercut, the slot and the passage within the head portion whereby said wearing portion is firmly secured in said construction.

2. A construction in accordance with claim 1 wherein the fingers of said ring member engage the body portion and lock the ring member flush against the head portion so that the wearing portion will not rotate about the head portion.

3. A construction in accordance with claim 2 wherein the fingers of said ring member are bent at an angle with respect to the plane of said ring member.

4. A construction in accordance with claim 3 wherein said fingers are bent at an angle between 30° and 60° relative to the plane of the ring member.

5. A construction in accordance with claim 2 wherein said fingers are twisted at an angle with respect to the plane of the ring member.

6. A construction in accordance with claim 5 wherein said fingers are twisted at an angle between 30° and 60° relative to the plane of the ring member.

7. A construction in accordance with claim 1 including an annular projection about the body portion and adjacent the head portion about which the molding material is formed to further secure the wearing portion to the construction.

8. A construction in accordance with claim 7 wherein the annular projection includes a sloped surface against which the molding material can be molded to form a pressfit between the wearing portion and the annular projection and to secure the wearing portion to the construction so that the wearing portion will not rotate about the head portion.

9. A replaceable heel lift construction comprising:

(a) an elongated body portion having a plurality of ridges extending axially along the body portion;

(b) a head portion having an upper surface being connected to the lower end of said body portion, and a lower surface including a slot extending radially therethrough across the head portion;

(c) a ring member fitting around said body portion adjacent the upper surface of said head portion, said ring member comprising a continuous outer peripheral portion and having inwardly extending fingers engaging said body portion and the upper surface of the head portion, the internal ends of said fingers defining a central opening in said ring member having a diameter slightly less than the outer diameter of said body portion whereby engagement of said fingers with said body portion and the upper surface of the head portion serves to hold the outer peripheral portion of said ring member in place on said body portion in spaced apart relationship with respect to said head portion;

(d) a wearing portion formed of a molding material surrounding said head portion, said ring member and the spaces defined between said fingers and between said outer peripheral portion and said body portion, said molding material also extending between said head portion and said ring member and within said slot within the head portion; and (e) an annular projection about the body portion and adjacent the head portion about which the molding material is formed whereby said wearing portion is firmly secured in said construction.

10. A construction in accordance with claim 9 wherein the fingers of said ring member engage the body portion and lock the ring member flush against the head portion so that the wearing portion will not rotate about the head portion.

11. A construction in accordance with claim 10 wherein the fingers of said ring member are bent at an angle with respect to the plane of said ring member.

12. A construction in accordance with claim 11 wherein said fingers are bent at an angle between 30° and 60° relative to the plane of the ring member.

13. A construction in accordance with claim 10 wherein said fingers are twisted at an angle with respect to the plane of the ring member.

14. A construction in accordance with claim 13 wherein said fingers are twisted at an angle between 30° and 60° relative to the plane of the ring member.

15. A construction in accordance with claim 9 wherein the annular projection includes a sloped surface against which the molding material can be molded to form a pressfit between the wearing portion and the annular projection and to secure the wearing portion to the construction so that the wearing portion will not rotate about the head portion.

* * * * *